US008509655B2

(12) United States Patent
Imanaka et al.

(10) Patent No.: US 8,509,655 B2
(45) Date of Patent: Aug. 13, 2013

(54) IMAGE FORMING APPARATUS

(75) Inventors: Yoshitaka Imanaka, Osaka (JP); Shinki Miyaji, Osaka (JP); Masaki Kadota, Osaka (JP); Masahito Ishino, Osaka (JP); Hiroka Itani, Osaka (JP)

(73) Assignee: Kyocera Mita Coporation (JP)

( * ) Notice: Subject to any disclaimer, the term of this patent is extended or adjusted under 35 U.S.C. 154(b) by 208 days.

(21) Appl. No.: 13/150,839

(22) Filed: Jun. 1, 2011

(65) Prior Publication Data

US 2011/0299891 A1 Dec. 8, 2011

(30) Foreign Application Priority Data

Jun. 4, 2010 (JP) ..... 2010-129100
Dec. 27, 2010 (JP) ..... 2010-290116

(51) Int. Cl.
*G03G 15/02* (2006.01)
*G03G 15/08* (2006.01)

(52) U.S. Cl.
USPC ..... 399/176; 399/285

(58) Field of Classification Search
None
See application file for complete search history.

(56) References Cited

U.S. PATENT DOCUMENTS

| | | | | |
|---|---|---|---|---|
| 4,822,711 | A * | 4/1989 | Itaya et al. | 430/122.8 |
| 2002/0045119 | A1 | 4/2002 | Azuma et al. | |
| 2004/0197115 | A1* | 10/2004 | Abe et al. | 399/176 |
| 2008/0226320 | A1* | 9/2008 | Sakata et al. | 399/55 |
| 2008/0292365 | A1* | 11/2008 | Fujishima et al. | 399/285 |
| 2010/0111551 | A1* | 5/2010 | Fujihara et al. | 399/55 |

FOREIGN PATENT DOCUMENTS

| | | |
|---|---|---|
| JP | 5-303259 | 11/1993 |
| JP | 2002-72511 | 3/2002 |
| JP | 2007-271731 | 10/2007 |

* cited by examiner

*Primary Examiner* — David Gray
*Assistant Examiner* — Sevan A Aydin
(74) *Attorney, Agent, or Firm* — Gerald E. Hespos; Michael J. Porco; Matthew T. Hespos

(57) ABSTRACT

An image forming apparatus, having: an image carrier configured by a positively charged single-layer electrophotographic photosensitive body; a charging device which is based on a contact charging method for charging a circumferential surface of the image carrier while making contact with the circumferential surface of the image carrier; a developing roller which is disposed so as to oppose the image carrier and carry and convey toner on the circumferential surface; and a voltage application unit which applies a developing bias to the developing roller, wherein the frequency of an AC component of the developing bias applied by the voltage application unit is 2.6 to 4.2 kHz.

3 Claims, 4 Drawing Sheets

IMAGE FORMING APPARATUS

BACKGROUND OF THE INVENTION

1. Field of the Invention

The present invention relates to an image forming apparatus.

2. Description of the Related Art

An image forming apparatus which uses an electrophotographic method, such as a copying machine, printer, facsimile machine, or a multifunction peripheral of these, for example, a photosensitive drum, which is an image carrier, a charging device for uniformly charging the circumferential surface of the photosensitive drum, an exposure device for forming an electrostatic latent image based on image data on the photosensitive drum, a developing device for developing an electrostatic latent image on the photosensitive drum, into a toner image, and a transfer device for transferring the toner image on the photosensitive drum onto a recording medium, such as paper, via an intermediate transfer belt, or the like.

The charging device used in an image forming apparatus of this kind may be, for example, a charging device based on a contact charging method or a charging device based on a non-contact charging method. It is known that charging devices based on a contact charging method can suppress the generation of ozone compared to a charging device based on a non-contact charging method.

Furthermore, one example of a charging device using a contact charging method is a device comprising a charging roller such as that described below, for instance. A more specific example is a charging roller used in an electrophotographic apparatus employing a two-component toner, the roller comprising a shaft body, a base rubber layer formed on the outer circumference of the shaft body, and a surface layer formed directly or via another layer on the outer circumference of the base rubber layer, wherein the base rubber layer is made of a base rubber layer forming material of which the main component is rubber having a JIS-A hardness of 15° or lower, and the surface layer is made of a surface forming material having an elongation (Eb) based on JIS K6251 of 5 to 90%, and a tensile strength (TS) of no less than 35 MPa.

SUMMARY OF THE INVENTION

The object of the present invention is to provide an image forming apparatus capable of forming an image of sufficiently high quality over a long period of time, as well as being able adequately to suppress the generation of ozone.

One aspect of the present invention which achieves this object is an image forming apparatus, comprising: an image carrier configured by a positively charged single-layer electrophotographic photosensitive body; a charging device which is based on a contact charging method for charging a circumferential surface of the image carrier while making contact with the circumferential surface of the image carrier; a developing roller which is disposed so as to oppose the image carrier and which carries and conveys toner on the circumferential surface; and a voltage application unit which applies a developing bias to the developing roller, wherein the frequency of an AC component of the developing bias applied by the voltage application unit is 2.6 to 4.2 kHz.

Further objects of the present invention and specific advantages obtained by the present invention will become apparent from the following description of the embodiments.

DETAILED DESCRIPTION OF THE PREFERRED EMBODIMENTS

Figure 1:
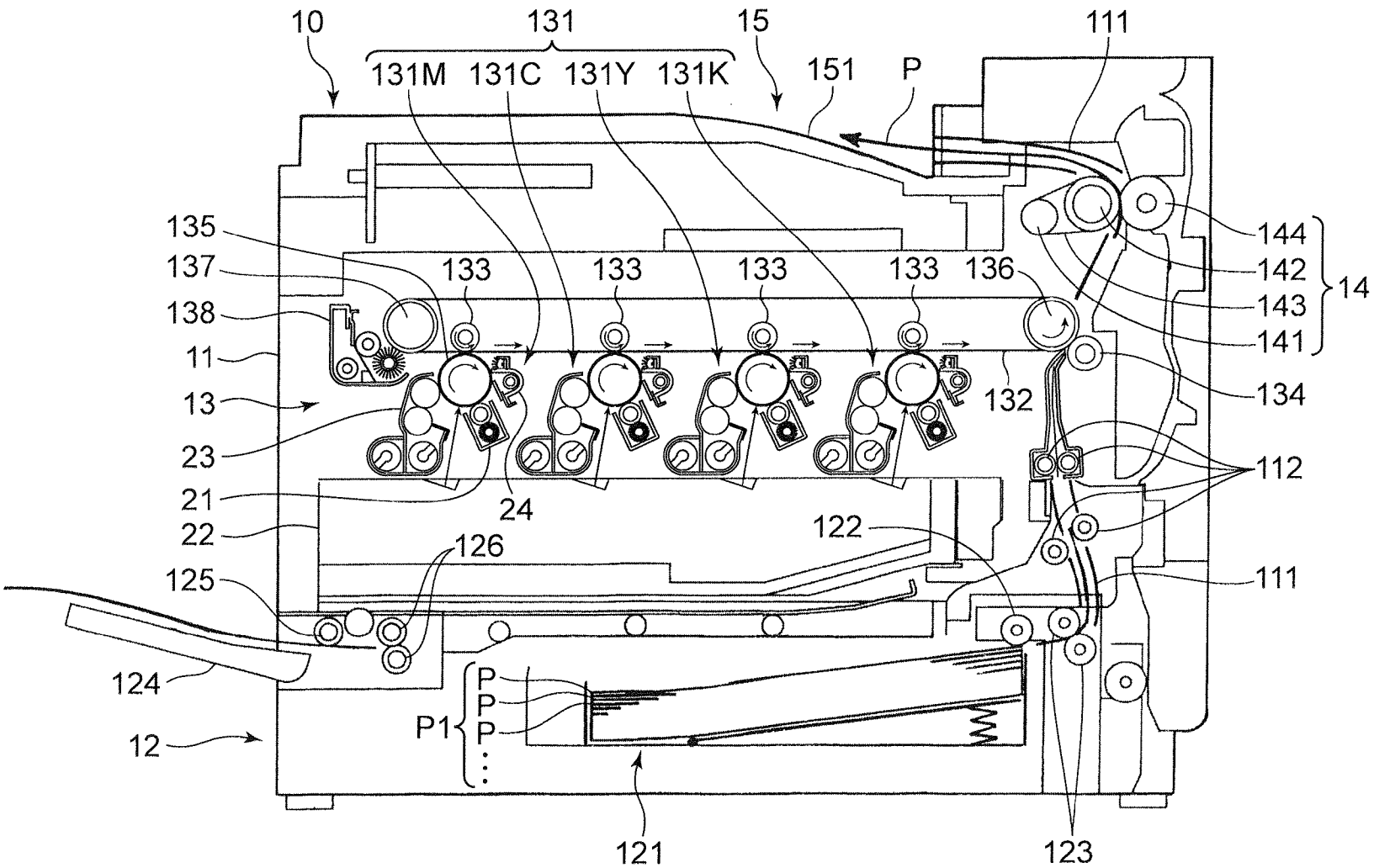
FIG. 1 is a schematic cross-sectional drawing showing the general composition of an image forming apparatus, relating to one embodiment of the present invention.

Apart from an inorganic body comprising a photosensitive layer consisting of an inorganic material, such as selenium, an image carrier provided in an image forming apparatus may be, for example, an organic photosensitive body having, as main components, organic components such as binding resin, a charge generation material, a charge transport material, or the like. An inorganic photosensitive body of this kind may be, for example, a single-layer organic photosensitive body having a photosensitive layer containing a charge generation material and a charge transport material in the same layer. Of single-layer organic photosensitive bodies of this kind, bodies which charge positively are called positively charged single-layer electrophotographic photosensitive bodies.

An organic photosensitive body such as a positively charged single-layer photosensitive body of this kind tends to have poor durability compared to an inorganic photosensitive body. It is known that a charging device based on a contact charging method tends to produce greater load on the photosensitive body than a charging device based on a non-contact charging method. For these reasons, the application of a charging device based on a contact charging method as a device for charging an organic photosensitive body which tends to have poor durability has not been investigated greatly.

Moreover, if a charging roller as described above is used, then it can be expected that high-quality copied images and printed images will be obtained for a long period of time. However, according to research by the present inventors, and others, there have been cases where it is not possible to form images of sufficiently high quality simply by using a charging roller according to the example described above as a charging roller of a charging device which charges a positively charged single-layer electrophotographic photosensitive body. In particular, it tends to become impossible to form satisfactory images if images are formed over a long period of time.

Moreover, the charging roller in the example described above is the result of investigating the surface layer, and the like, considering application in a charging device of an image forming apparatus which uses a two-component toner and where there is a risk of carrier becoming interposed between the photosensitive body and the charging roller, and it has not been used as a charging roller of a charging device which charges a positively charged single-layer electrophotographic photosensitive body.

In this respect, the present inventors, and others, discovered that if a charging device based on a contact charging method is simply used as a device which charges a positively charged single-layer photosensitive body that forms an image carrier, then although the surface of the photosensitive layer of the positively charged single-layer photosensitive body is charged, it cannot readily be charged uniformly and there is a tendency for charging irregularities to occur. It was observed that this tendency is liable to occur after image formation for a long period of time. This is thought to be because, in a formed image, there generally exists an image area and a non-image area, and therefore in the transfer of the toner onto a transfer receiving body, such as an intermediate belt or paper, the voltage applied to the circumferential surface of the image carrier is not uniform throughout the circumferential surface of the image carrier, and furthermore, the light exposure is not uniform either. It is thought that charging non-uniformities occur even if an image carrier in this state is de-charged and then charged again.

Furthermore, it is thought that this charging non-uniformity can be eliminated by charging with a charging device in such a manner that the surface potential of the circumferential surface of the image carrier reaches a sufficiently high level. However, if using a positively charged single-layer photosensitive body as an image carrier, there is a risk of causing damage to the photosensitive layer of the image carrier if charging is performed so that the surface potential of the image carrier assumes a sufficiently high level.

Therefore, the present inventors, and others, arrived at the present invention described below, as a result of painstaking research into conditions whereby high-quality images can be obtained even if there is a certain degree of charging non-uniformity.

Embodiments relating to the present invention are described below, but the present invention is not limited to these. Here, an image forming apparatus based on a tandem system is given as an example of an image forming apparatus, but the image forming apparatus is not limited to an image forming apparatus based on a tandem system, provided that it is an apparatus using an electrophotographic method. Furthermore, a color printer is described as an example of the type of the image forming apparatus, but the image forming apparatus is not limited to a color printer, and may also be a copying machine, a facsimile machine, a multifunction peripheral, or the like.

The image forming apparatus relating to an embodiment of the present invention comprises an image carrier configured by a positively charged single-layer electrophotographic photosensitive body, a charging device based on a contact charging method which charges a circumferential surface of the image carrier while making contact with the circumferential surface of, the image carrier, a developing roller which is arranged so as to oppose the image carrier and which carries and conveys toner on a circumferential surface, and a voltage application unit which applies a developing bias to the developing roller, wherein a frequency of an AC component of the developing bias applied by the voltage application unit is 2.6 to 4.2 kHz.

An image forming apparatus of this kind is capable of forming an image of sufficiently high quality over a long period of time, as well as being able adequately to suppress the generation of ozone. More specifically, the image forming apparatus thus obtained is able to form an image of a sufficiently high quality over a long period of time, even if using a charging device based on a contact charging method.

This is thought to be due to the following reasons.

Firstly, a charging device based on a contact charging method charges a circumferential surface of an image carrier in a state of contact with the circumferential surface of the image carrier, and therefore it is possible to suppress the generation of ozone compared to a charging device based on a non-contact charging method. Consequently, it is thought that the generation of ozone can be suppressed adequately by using a charging device based on a contact charging method.

Furthermore, if the AC component of the developing bias applied to the developing roller by the voltage application unit has a high frequency, then it is considered that there will be large variation in the magnitude of the force applied in the direction of movement of the toner to the developing roller. More specifically, if the force applied in the direction of movement of the toner to the developing roller is a large force, then the toner adheres preferentially to the image area of the electrostatic latent image. If the force applied in the direction of movement of the toner to the developing roller is a small force, then toner which has adhered to the non-image area of the electrostatic latent image is removed, while the toner which has adhered to the image area of the electrostatic latent image is left. Consequently, image reproducibility is improved and dot reproducibility is improved because toner adheres to the image area of the electrostatic latent image, and toner does not adhere to the non-image area of the electrostatic latent image. For this reason, if the frequency is too high, then there is a tendency for the charging non-uniformity to be reproduced faithfully.

Moreover, if the frequency if too low, then although the dot reproducibility as described above falls and reproduction of the charging non-uniformity is suppressed, the force moving the toner to the image area of the electrostatic latent image also falls and hence reproducibility tends to decline. In other words, it tends to become impossible to achieve sufficient image density.

From the above, by keeping the frequency to the range described above, even if image formation is carried out over a long period of time, it is possible to form an image of high quality having good image reproducibility, while suppressing the occurrence of non-uniformities in image density as a result of charging non-uniformity. More specifically, by keeping the frequency to the range described above, in an image forming apparatus which uses a positively charged single-layer electrophotographic photosensitive body having a relatively breakable photosensitive layer as an image carrier, it is possible adequately to suppress breaking of the photosensitive layer and it is possible to form an image of high quality within the range of the surface potential of the image carrier. Furthermore, since a charging device based on a contact charging method is used as the charging device, then generation of ozone can be suppressed adequately. Therefore, it is possible to form an image of sufficiently high quality over a long period of time, as well as being able adequately to suppress the generation of ozone.

FIG. 1 is a schematic cross-sectional drawing showing the general composition of an image forming apparatus 10 relating to one embodiment of the present invention. As an example of an image forming apparatus 10 relating to an embodiment of the present invention, an image forming apparatus (color printer) 10 is described, which carries out image formation processing on the basis of image information sent from an external device, such as a computer.

As shown in FIG. 1, the image forming apparatus 10 comprises, provided inside an apparatus main body 11 having a box shape: a paper supply unit 12 which supplies paper P, an image forming section 13 which forms a toner image based on image information on the paper P, while conveying the paper P supplied from the paper supply unit 12, and a fixing unit 14 which performs a fixing process for fixing an unfixed toner image formed on paper P, to the paper P, by means of an image forming section 13. Moreover, a paper output unit 15 which outputs the paper P that has undergone a fixing process by the fixing unit 14 is formed in the upper part of the apparatus main body 11.

An operating panel (not illustrated) for inputting output conditions, and the like, relating to the paper P is provided in a suitable portion of the upper face of the apparatus main body 11. A numerical key pad and various keys, and the like, for inputting output conditions are provided in this operating panel.

Furthermore, a paper conveyance path 111 extending in the vertical direction is formed in a position to the right-hand side of the image forming section 13 shown in FIG. 1, inside the apparatus main body 11. A conveyance roller pair 112 is provided in a suitable position of the paper conveyance path 111. The paper P is conveyed along the paper conveyance path 111 from the paper supply unit 12 to the paper output unit 15 by the conveyance roller pair 112, and during this conveyance, the paper P is formed so as to pass through a transfer section of the image forming section 13 and the fixing unit 14.

The paper supply unit 12 comprises a paper supply tray 121, a pick-up roller 122 and a paper supply roller pair 123. The paper supply tray 121 is installed so as to be insertable, and detachable at a position below the image forming section in the apparatus main body 11, and a paper stack P1 comprising a stacked plurality of sheets of paper P is collected in the paper supply tray 121. The pick-up roller 122 is provided in a position above the paper supply tray 121 to the upstream side thereof in terms of the direction of conveyance of the paper P, and more specifically, to the upper right-hand side in FIG. 1, and the roller pays out sheets of paper P on the uppermost surface of the paper stack P1 collected in the paper supply tray 121, one by one. The paper supply roller pair 123 outputs the paper P paid out by the pick-up roller 122, to the paper conveyance path 111. In so doing, the paper supply unit 12 supplies paper P to the image forming section 13.

Furthermore, the paper supply unit 12 also comprises a manual feed tray 124 which is installed on the left-hand side face in FIG. 1 of the apparatus main body 11, a pick-up roller 125, and a paper supply roller pair 126. The manual feed tray 124 serves to supply paper P to the image forming section 13 by a manual feed operation. The manual feed tray 124 can be accommodated in the side face of the apparatus main body 11, and when paper P is supplied by a manual feed operation, the manual feed tray is pulled out from the side face of the apparatus main body 11 in preparation for manual paper supply, as shown in FIG. 1. The pick-up roller 125 pays out paper P loaded in manual feed tray 124. The paper P paid out by the pick-up roller 125 is output to the paper conveyance path 111, by the paper supply roller pairs 126. In so doing, the paper supply unit 12 supplies paper P to the image forming section 13.

The image forming section 13 forms an image, such as a color image, on paper P supplied from the paper supply unit 12 by means of prescribed image processing. The image forming section 13 comprises a plurality of image forming units 131, an intermediate transfer belt (intermediate transfer body) 132, primary transfer rollers 133 and a secondary transfer roller 134.

In the present embodiment, the image forming units 131 comprise a magenta unit 131M which uses a magenta (M) color developer, a cyan unit 131C which uses cyan (C) color developer, a yellow unit 131Y which uses yellow (Y) color developer, and a black unit 131K which uses black (K) color developer, these units being arranged successively from the upstream side toward the downstream side in terms of the direction of rotation of the intermediate transfer belt 132 (from left to right in FIG. 1). The units 131 each comprise a photosensitive drum 135 forming an image carrier, a toner image corresponding to the respective color is formed on the photosensitive drum 135 on the basis of image information and the toner image is transferred in primary transfer to the intermediate transfer belt 132. The composition of the image forming unit 131 is described hereinafter.

The intermediate transfer belt 132 is used to transfer a toner image (by primary transfer) based on image information onto the circumferential surface (contact surface) thereof, by means of a plurality of image forming units 131. More specifically, in the present embodiment, the intermediate transfer belt 132 is a transfer receiving body which is sandwiched between the photosensitive drum 135 and the primary transfer rollers 133, and which has a circumferential surface onto which a toner image is transferred from the photosensitive drum 135.

Moreover, the intermediate transfer belt 132 is an endless belt-shaped rotating body which is spanned about a drive roller 136 and an idle roller 137, in such a manner that the circumferential surface of the belt abuts respectively against each of the photosensitive drums 135. Furthermore, the intermediate transfer belt 132 is composed so as to rotate endlessly due to rotational driving of the drive roller 136, in a state of being pressed against the respective photosensitive drums 135 by the respective primary transfer rollers 133 which are arranged at positions opposing the photosensitive drums 135 via the intermediate transfer belt 132. The driving roller 136 is driven to rotate by a drive source, such as a stepping motor, and applies a drive force for endlessly rotating the intermediate transfer belt 132. The idle roller 137 is provided rotatably and rotates idly due to the endless rotation of the intermediate transfer belt 132 by the drive roller 136.

Furthermore, there are no particular restrictions on the intermediate transfer belt 132, but a more specific example is a belt constituted by a seamless belt made of resin, such as polyimide, polycarbonate, polyvinylidene fluoride, etc., on the surface of which a coating layer of silicone rubber, fluorine rubber, or the like, is provided. One example of a desirable intermediate transfer belt 132 is a belt comprising a CR (chloroprene) rubber layer on an under layer of PVDF (polyvinylidene fluoride), and a coating layer of PTFE (polytetrafluoroethylene) thereon. The coating layer may also contained added conductive filler, such as carbon black, in order to impart conductive properties.

The primary transfer rollers 133 transfer toner images formed on the photosensitive drum 135 to the intermediate transfer belt 132, as primary transfer step. More specifically, in the present embodiment, each primary transfer roller 133 is a transfer unit which executes primary transfer to transfer a toner image on the circumferential surface of a photosensitive drum 135 primarily onto the intermediate transfer belt 132 by gripping the intermediate transfer belt 132.

Furthermore, the primary transfer rollers 133 are arranged at positions opposing the respective photosensitive drums 135 via the intermediate transfer belt 132. The primary transfer rollers 133 are provided respectively for the photosensitive drums 135 of each image forming unit 131. Furthermore, as described above, the primary transfer rollers 133 contact the intermediate transfer belt 132 in such a manner that the intermediate transfer body 132 is pressed against the photosensitive drums 135. Furthermore, the primary transfer rollers 133 rotate idly due to the endless rotation of the intermediate transfer belt 132, while remaining in contact with the intermediate transfer belt 132. In this, by applying a primary transfer bias voltage which has the opposite polarity to the charging polarity of the toner, to each of the primary transfer rollers 133, the toner images formed on the respective photosensitive drums 135 are primarily transferred to the intermediate transfer body 132 between the respective photosensitive drums 135 and the respective primary transfer rollers 133 corresponding to these. By this means, the toner images formed on the photosensitive drums 135 are primarily transferred, successively, in a mutually superimposed state, to the intermediate transfer body 132 which rotates in the direction indicated by the arrow (the counter-clockwise direction in FIG. 1).

Figure 2:
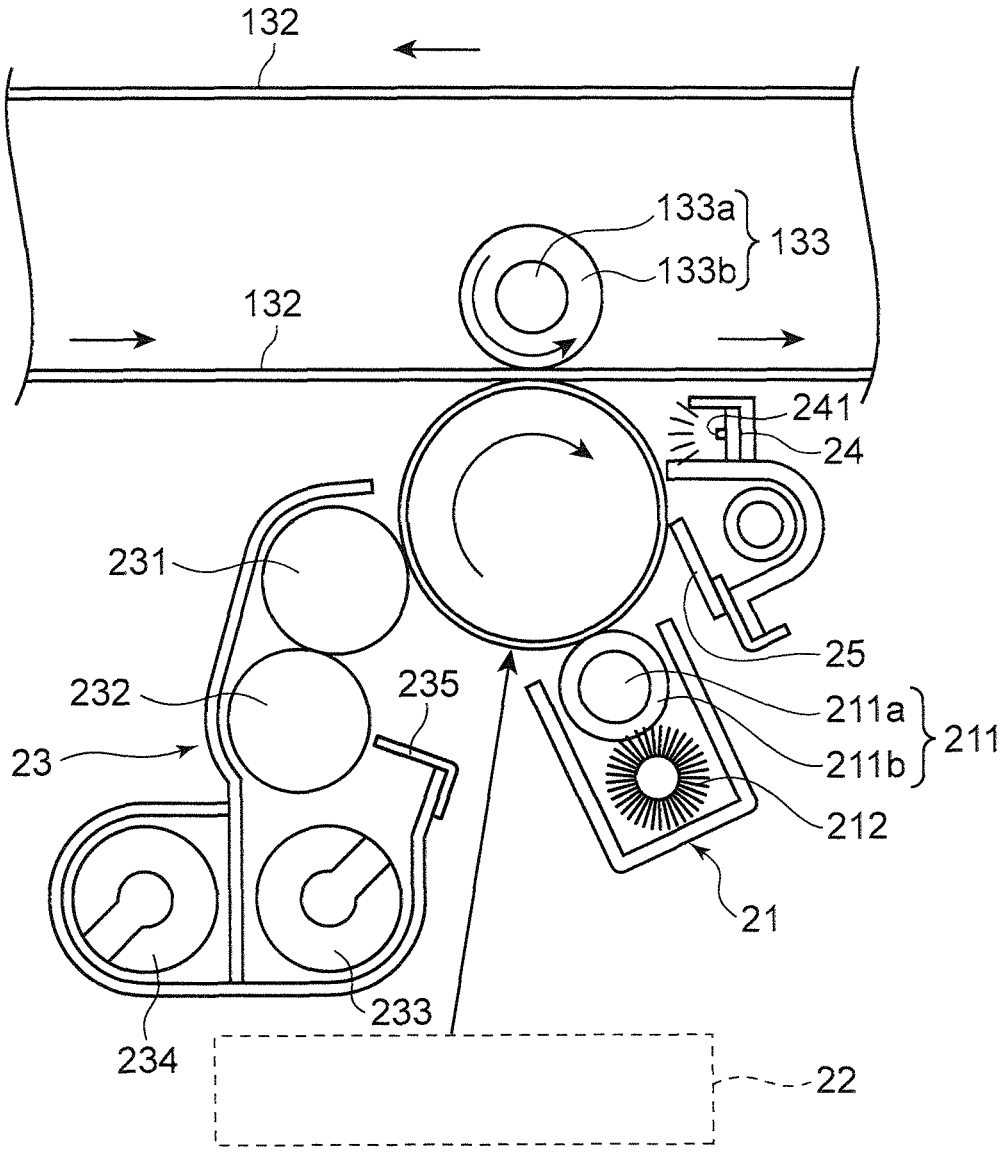
FIG. 2 is an approximate cross-sectional diagram showing an enlarged view of the periphery of an image forming unit of the image forming apparatus relating to an embodiment of the present invention.

Furthermore, there are no particular restrictions on the primary transfer rollers 133, provided that they are capable of performing the primary transfer described above, but in the present embodiment, as shown in FIG. 2, the primary transfer rollers 133 each comprise a metal core 133*a* which is supported rotatably, a surface section 133*b*, covering the metal core 133*a*, which contacts the intermediate transfer body 132, and a primary transfer bias voltage application unit (not illustrated) which applies a primary transfer bias voltage to the metal core 133*a*. In the present embodiment, the metal core 133*a* is an application unit to which a primary transfer bias voltage is applied. FIG. 2 is an approximate cross-sectional diagram showing an enlarged view of the periphery of an image forming unit 131 of the image forming apparatus 10 relating to an embodiment of the present invention.

Furthermore, there are no particular restrictions on the primary transfer roller 133, but a specific example is one where the surface section 133*b* is constituted by a foamed resin layer containing a conductive agent. More specifically, for example, the surface section 133*b* is constituted by foamed EPDM with added carbon black, for instance.

Moreover, the volume resistivity of at least one of the intermediate transfer body 132 and the surface section 133*b* of the primary transfer roller 133 is desirably $10^7$ to $10^9$ Ω·cm, and more desirably, $10^{7.5}$ to $10^9$ Ω·cm. In other words, between the photosensitive drum 135 and the metal core 133*a* of the primary transfer roller 133 there is desirably a region having a volume resistivity of $10^7$ to $10^9$ Ω·cm, and more desirably, a region having a volume resistivity of $10^{7.5}$ to $10^9$ Ω·cm. The volume resistivity can be measured by a commonly known measurement method, and can be measured by a general resistivity measurement device.

The volume resistivity of the intermediate transfer body 132 can be adjusted by adjusting the amount of conductive filler contained therein, or by the type of resin constituting the belt. Furthermore, the volume resistivity of the surface section 133*b* of the primary transfer roller 133 can be adjusted by adjusting the amount of conductive agent contained therein or by the type of the foamed resin.

Moreover, desirably, at least one of the volume resistivity of the intermediate transfer body 132 and the surface section 133*b* of the primary transfer roller 133 should be within the aforementioned range, and desirably, the volume resistivity of the surface section 133*b* of the primary transfer roller 133 is within the aforementioned range. More specifically, desirably, the volume resistivity of the surface section 133*b*, which is the portion of the primary transfer roller 133 that makes contact with the circumferential surface of the photosensitive drum 135, is no less than $10^{7.5}$ Ω·cm.

If the volume resistivity of either the intermediate transfer body 132 or the surface section 133*b* of the primary transfer roller 133 is too low, then image density non-uniformities occur, and it tends to be impossible to form images of sufficiently high quality over a long period of time. This is because, when forming an image, there are portions where toner is present and portions where toner is not present in the nip section formed by the photosensitive drum and the primary transfer roller, and if a primary transfer bias voltage is applied to the primary transfer roller, then the voltage applied to the circumferential surface of the photosensitive drum has insufficient uniformity throughout the circumferential surface. It is thought that charging irregularities occur even if a photosensitive drum in this state is de-charged and then charged again. Therefore, image density non-uniformities occur in the image formed as a result of the charging non-uniformities which are produced in this way.

Therefore, by setting the volume resistivity of at least one of the intermediate transfer body 132 and the surface section 133*b* of the primary transfer roller 133 within the aforementioned range, then even if the charging bias voltage applied by the charging device, which is described hereinafter, is a charging bias voltage whereby the surface potential of the photosensitive drum 135 assumes an electric potential that does not risk breakage of the photosensitive layer, it is still possible to form an image of sufficiently high quality over a long period of time.

This is thought to be because, when forming an image, even though there are portions where toner is present and portions where toner is not present in the nip section formed by the photosensitive drum and the primary transfer roller, if a primary transfer bias voltage is applied to the primary transfer roller, then the voltage applied to the circumferential surface of the photosensitive drum has sufficient uniformity throughout the circumferential surface.

There are no particular restrictions on the upper limit value of the volume resistivity, but from the viewpoint of manufacturing the intermediate transfer body 132 and the surface section 133*b* of the primary transfer roller 133, the volume resistivity is desirably no more than $10^9$ Ω·cm.

The secondary transfer roller 134 serves to transfer toner images on the intermediate transfer body 132 onto paper P which is supplied from the paper supply unit 12 (secondary transfer). More specifically, in the present embodiment, the secondary transfer roller 134 is a secondary transfer unit which forms a nip section by contacting the circumferential surface of the intermediate transfer body 132, and which executes secondary transfer to transfer the toner image on the circumferential surface of the intermediate transfer body 132 secondarily to paper P, which is a recording medium passing through the nip section.

Furthermore, the secondary transfer roller 134 is arranged at a position opposing the drive roller 136 via the intermediate transfer belt 132. Furthermore, the secondary transfer roller 134 rotates idly due to the endless rotation of the intermediate transfer belt 132, while remaining in contact with the intermediate transfer belt 132. In this case, by applying a secondary transfer bias voltage having opposite polarity to the charging polarity of the toner, to the secondary transfer roller 134, the toner image transferred primarily onto the intermediate transfer body 132 is then transferred secondarily to the paper P supplied from the paper supply unit 12, between the secondary transfer roller 134 and the drive roller 136. By this means, a toner image based on image information is transferred to the paper P in an unfixed state.

Furthermore, the image forming section 13 further comprises a head cleaning device 138 provided at a position to the downstream side of the secondary transfer position and to the upstream side of the primary transfer position in terms of the direction of rotation of the intermediate transfer body 132. The head cleaning device 138 serves to remove and clean toner remaining on the circumferential surface of the intermediate transfer body 132 after secondary transfer. The circumferential surface of the intermediate transfer body 132 which has undergone a cleaning process by the head cleaning device 138 is then conveyed to the primary transfer position for a new primary transfer process. The waste toner removed by the head cleaning device 138 is recovered and collected in a toner recovery bottle (not shown) via a prescribed path.

The fixing unit 14 performs a fixing process of the toner image on the paper P which has been transferred by the image forming section 13. The fixing unit 14 comprises a heating roller 141 including an internal electrical heating body which is a heating source, a fixing roller 142 which is arranged opposing the heating roller 141, a fixing belt 143 which is spanned between the fixing roller 142 and the heating roller 141, and a pressurization roller 144 which is arranged opposing the fixing roller 142 via a fixing belt 143.

The paper P supplied to the fixing unit 14 is heated and pressurized by passing through the fixing nip section formed between the fixing belt 143 and the pressurization roller 144. By this means, the toner image transferred to the paper P in the image forming section 13 is fixed to the paper P. The paper P which has completed a fixing process is output, via the paper conveyance path 111 extended from the upper part of the fixing unit 14, to a paper output tray 151 of the paper output unit 15 which is provided in the top portion of the apparatus main body 11.

The paper output section 15 is formed by creating a depression in the top part of the apparatus main body 11, and a paper output tray 151 which receives output paper P is formed in the bottom part of this depression.

Next, the image forming units 131 will be described.

The image forming unit 131 is disposed with the photosensitive drum 135 which forms an image carrier provided rotatable in the direction of the arrow (the clockwise direction in FIG. 2) in a central position. Taking the position of transfer (primary transfer) by the primary transfer roller 133 as the furthest upstream position in terms of the direction of rotation of the photosensitive drum 135, a charge removal device 24, a cleaning device 25, a charging device 21, an exposure device 22 and a developing device 23 are arranged about the periphery of the photosensitive drum 135 respectively to create a charge removal position, a cleaning position, a charging position, an exposure position and a developing position, successively toward the downstream side from the position of the primary transfer roller 133.

The photosensitive drum 135 is used to form a toner image corresponding to the respective color on the basis of image information, on the circumferential surface thereof, by means of a charging process, an exposure process, a developing process, a charge removal process, and a cleaning process. A positively charged single-layer electrophotographic photosensitive body is used as a photosensitive drum 135.

The charging device 21 serves to charge the circumferential surface of the photosensitive drum 135 which rotates in the direction indicated by the arrow. A charging device based on a contact charging method is used as the charging device 21. By this means, the charging device based on a contact charging method charges the circumferential surface of the image carrier in a state of contact with the circumferential surface of the image carrier, and therefore it is possible to suppress the generation of ozone compared to a charging device based on a non-contact charging method.

Furthermore, there are no particular restrictions on the charging device 21, provided that the charging device is based on a contact charging method, but in the present embodiment, the charging device 21 comprises a charging roller 211 which makes contact with the circumferential surface of the photosensitive drum 135, and a charge cleaning brush 212 for removing toner that has adhered to the charging roller 211.

The charging roller 211 is a charging member for charging the circumferential surface of the photosensitive drum 135 while in a state of contact with the circumferential surface of the photosensitive drum 135. Furthermore, there are no particular restrictions on the charging roller 211, but in the present embodiment, as shown in FIG. 2, the charging roller 211 comprises a metal core 211*a* which is supported rotatably, a surface section 211*b*, covering the metal core 211*a*, which contacts the photosensitive drum 135, and a charging bias voltage application unit (not illustrated) which applies a charging bias voltage to the metal core 211*a*. The charging roller 211 rotates idly with the rotation of the photosensitive drum 135 while in a state of contact with the photosensitive drum 135. In so doing, the circumferential surface of the photosensitive drum 135 is charged by the application of a charging bias voltage to the metal core 211*a* of the charging roller 211.

Furthermore, the surface section 211*b*, in other words, the portion of the charging roller 211 which makes contact with the circumferential surface of the photosensitive drum 135, desirably has a rubber hardness of 62 to 81° (Asker C hardness), and more desirably, 65 to 75°. If the surface section 211*b* is too soft, then it tends to be impossible to obtain suitable uniformity of charging to enable the roller to function as a charging roller of a charging device based on a contact charging method. Furthermore, if the surface section 211*b* is too hard, then it tends to be impossible to control charging non-uniformities. Therefore, if the surface section 211*b* has the hardness described above, then it is possible to form images of higher quality over a long period of time and damage to the photosensitive drum 135 can be suppressed. The rubber hardness can be measured by a commonly known method, and more specifically, can be measured using a method as stated in the following embodiments.

This is thought to be because, firstly, the portion in contact with the photosensitive drum 135 is relatively soft, having a Asker C hardness of 62 to 81°, and hence damage to the photosensitive drum 135 can be suppressed. In addition, by making the portion in contact with the photosensitive drum 135 relatively soft, then it is possible to achieve a broad region where the circumferential surface of the charging roller 211 and the circumferential surface of the photosensitive drum 135 are in close proximity to each other and discharge between the charging roller 211 and the circumferential surface of the photosensitive drum 135 is possible, in other words, a broad region which contributes to the charging of the circumferential surface of the photosensitive drum 135. It is thought that, for this reason, the circumferential surface of the photosensitive drum 135 can be charged satisfactorily.

Furthermore, there are no particular restrictions on the layer thickness of the surface section 211*b*, but in specific terms, it is desirably 1 to 3 mm, for example.

Furthermore, there are no particular restrictions on the material which constitutes the surface section 211*b*, provided that it is capable of constituting a surface section of the charging roller. More specifically, it may be composed of rubber, such as epichlorohydrin rubber, urethane rubber, silicone rubber, nitrile rubber (NBR), chloroprene (CR) rubber, and the like, with added conductive material, such as carbon. Of these, from the viewpoint of ozone resistance, low temperature characteristics, and uniformity of conduction (little difference in resistance depending on the position), epichlorohydrin rubber, nitrile rubber (NBR), or the like, containing added conductive material, such as carbon, is desirable.

Furthermore, in the present embodiment, the surface roughness of the charging roller 211 is desirably 55 to 130 μm, in terms of the average distance (Sm) between asperity peaks on a cross-sectional curve, and the ten-point average roughness (Rz) is desirably 9 to 19 μm. By adopting a composition of this kind, charging non-uniformities can be suppressed sufficiently, and furthermore, the occurrence of detachment of the photosensitive layer can also be suppressed. The average distance (Sm) between asperity peaks on a cross-sectional curve and the ten-point average hardness (Rz) can be measured by a commonly known method, and more specifically, can be measured using a method as stated in the following embodiments.

Furthermore, desirably, the charging device 21 is charged so that the surface potential of the photosensitive drum 135 becomes 510 to 600V. If the surface potential is too low, then there are marked charging non-uniformities due to small changes in surface potential, and there is a tendency for fogging, or the like, to occur. Therefore, by charging as described above, it is possible to form an image of higher quality. This is thought to be because it is possible to suppress the generation of charging non-uniformity by charging the circumferential surface of the photosensitive drum 135 in such a manner that the surface potential becomes sufficiently high, as in the aforementioned range, provided that the photosensitive layer of the photosensitive drum 135 is not damaged. Furthermore, in the present embodiment, an organic photosensitive body such as a positively charged single-layer electrophotographic photosensitive body such as that described below is used as an image carrier, and therefore it is desirable to perform charging so that the surface potential becomes no more than 600V, in such a manner that the photosensitive layer is not broken.

Moreover, it is desirable that the charging bias voltage applied by the charging bias voltage application section of the charging device 21 should be no less than 1000V. If the charging bias voltage is too low, then the surface potential of the photosensitive drum 135 becomes too low, there is marked charging non-uniformity due to slight change in the surface potential, and there is a tendency for fogging, or the like, to occur. Therefore, by applying a charging bias voltage as described above, it is possible to form an image of higher quality. This is thought to be because it is possible to suppress the generation of charging non-uniformity by charging the circumferential surface of the photosensitive drum 135 in such a manner that the surface potential becomes sufficiently high, as in the aforementioned range, provided that the photosensitive layer of the photosensitive drum 135 is not damaged.

Moreover, the charging bias voltage is desirably only a DC voltage. By this means, even if the positively charge single-layer electrophotographic photosensitive body as described below is used, it is still possible further to reduce the amount of wear of the photosensitive layer. More specifically, it is possible to reduce the amount of wear of the photosensitive layer further if only a DC voltage is applied, compared to a case where an AC voltage or a superimposed voltage in which an AC voltage is superimposed on a DC voltage is used.

Furthermore, if an AC voltage is applied, it tends to be possible to achieve a uniform potential on the surface (circumferential surface) of the image carrier by charging, but in the image forming apparatus relating to the present embodiment, a charging device based on a contact charging method rather than a non-contact method is used, and therefore it is possible to achieve uniform charging even if only a DC voltage is applied.

Consequently, by applying only a DC voltage to the charging roller, it is possible to form a satisfactory image and furthermore the amount of wear of the photosensitive layer can be reduced.

The exposure device 22 forms an electrostatic latent image based on image information on the circumferential surface of the photosensitive drum 135, which has been charged by the charging device 21, by irradiating laser light based on the image information onto the circumferential surface of the photosensitive drum 135. Possible examples of the exposure device 22 are, for instance, an LED head unit or a laser scanning unit (LSU), or the like.

Figure 3:
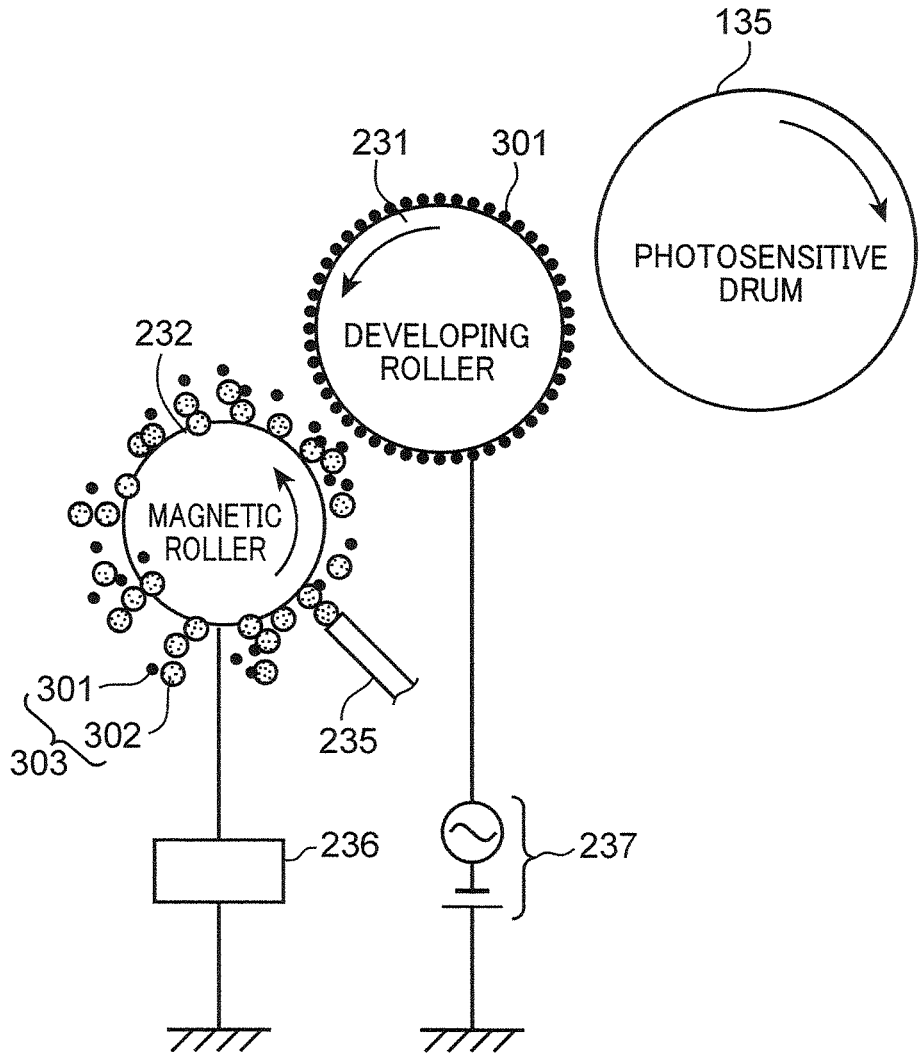
FIG. 3 is a conceptual diagram for describing development by a developing device provided in an image forming apparatus relating to the present embodiment.

The developing device 23 serves to develop an electrostatic latent image that has been formed on the circumferential surface of a photosensitive drum 135 into a toner image. The developing device 23 is described with reference to FIGS. 2 and 3. FIG. 3 is a conceptual diagram for describing development by a developing device 23 provided in an image forming apparatus 10 relating to an embodiment according to the present invention; the relative positions of the photosensitive drum 135, the developing roller 231, the magnetic roller 232 and a regulating blade 235 are different to FIG. 2.

The developing device 23 comprises a developing roller 231, a magnetic roller 232, a paddle mixer 233, an agitation mixer 234, a regulating blade 235, a toner supply bias voltage application unit 236, and a developing bias voltage application unit 237.

The developing roller 231 is disposed so to respectively oppose the photosensitive drum 135 and the magnetic roller 232, in such a manner that the opposing circumferential surfaces are in a mutually proximate but separated state. More specifically, the developing roller 231 and the photosensitive drum 135 are arranged in such a manner that their respective circumferential surfaces are in a mutually proximate but separated state. Furthermore, the developing roller 231 and the magnetic roller 232 are also arranged in such a manner that their respective circumferential surfaces are in a mutually proximate but separated state.

By arranging the developing roller 231 and the photosensitive drum 135 in such a manner that their circumferential surfaces are in a mutually proximate but separated state in this way, it is possible to form images of even higher quality over a long period of time while suppressing the generation of ozone, and it is also possible further to suppress damage to the image carrier.

This is thought to be because it is possible to display a satisfactory effect in being able to form an image of high quality having good image reproducibility, while suppressing the occurrence of non-uniformities in image density as a result of charging non-uniformity, even if image formation is carried out over a long period of time. Next, since the photosensitive drum 135 does not make contact with the developing roller 231, then it is possible further to suppress damage to the photosensitive drum 135.

The magnetic roller 232 carries a two-component developer including toner on the circumferential surface thereof due to a magnet which is disposed inside the roller, and conveys the toner to the vicinity of the developing roller 231 by rotating in this state. By this means, the magnetic roller 232 supplies toner of the two-component developer to the developing roller 231.

The developing roller 231 carries toner than has been supplied from the magnetic roller 232, on the circumferential surface thereof, and conveys the toner to the vicinity of the photosensitive drum 135 by rotating in this state. By this means, an electrostatic latent image formed previously on the circumferential surface of the photosensitive drum 135 is realized (developed) as a toner image.

The paddle mixer 233 and the agitation mixer 234 have spiral-shaped blades and charge the toner contained in the two-component developer by agitating the two-component developer while conveying the developer in opposite directions. Moreover, the paddle mixer 233 supplies the two-component developer containing charged toner to the magnetic roller 232.

The regulating blade 235 is disposed with one end thereof facing the circumferential surface of the magnetic roller 232, and regulates the thickness of the two-component developer carried on the magnetic roller 232.

The toner supply bias voltage application unit 236 serves to apply a toner supply bias voltage to the magnetic roller 232. By applying a toner supply bias voltage, the toner in the two-component developer conveyed to the vicinity of the developing roller 231 is propelled onto the developing roller 231, by the magnetic roller 232.

Furthermore, the developing bias voltage application unit 237 applies a developing bias voltage to the developing roller 231. By applying this developing bias voltage, the toner conveyed to the vicinity of the photosensitive drum 135 by the developing roller 231 is propelled onto the photosensitive drum 135.

More specifically, development is performed as described below.

The two-component developer 303 including a toner 301 which has been charged by the paddle mixer 233 and the agitation mixer 234, and a carrier 302, is supplied to the magnetic roller 232. The two-component developer 303 supplied to the magnetic roller 232 is conveyed by the magnetic roller 232 to the developing roller 231. The two-component developer 303 conveyed by the magnetic roller 232 passes between the regulating blade 235 and the magnetic roller 232 before being conveyed to the vicinity of the developing roller 231, and in so doing, the thickness of the developer on the roller is regulated. A potential difference is then produced between the developing roller 231 and the magnetic roller 232, due to the toner supply bias voltage applied by the toner supply bias voltage application unit 236. Consequently, when the two-component developer 303 of which the thickness has been regulated is moved to the vicinity of the developing roller 231, due to this potential difference, only the charged toner 301 is transferred to the developing roller 231. The toner 301 transferred to the developing roller 231 is a uniform toner layer.

The two-component developer 303 uses a developer including a toner 301 and a carrier 302, for example. The toner 301 is, for example, constituted by toner particles including binding resin, a colorant, a separating agent, and the like, and an external additive which is added externally to the toner particles. The toner 301 used is desirably a so-called "non-magnetic toner". The carrier 302 consists of magnetic particles made of ferrite, or the like, and serves to charge the toner 301. A prescribed amount of carrier 302 is filled previously into the developing device 23, and the toner 301 is replenished suitably to the developing device 23 from a toner cartridge (not illustrated).

A potential difference is generated between the photosensitive drum 135 and the developing roller 231 by the developing bias voltage application unit 237. Consequently, when the toner on the developing roller 231 moves to the vicinity of the photosensitive drum 135, due to this potential difference, the toner 301 is propelled and caused to adhere to the image area of the electrostatic latent image formed on the circumferential surface of the photosensitive drum 135, in a so-called non-magnetic non-contact development process. In this way, the developing device 23 is able to perform development on the basis of the electrostatic latent image.

Furthermore, the developing bias voltage application unit 237 comprises an AC power supply which applies an AC voltage. More specifically, the developing bias voltage applied by the developing bias voltage application unit 237 includes an AC component. The frequency of the AC component is 2.6 to 4.2 kHz. In this way, it is possible to form an image of sufficiently high quality over a long period of time. More specifically, it is possible to form an image of a sufficiently high quality over a long period of time, even if using a charging device based on a contact charging method.

This is thought to be due to the following reasons.

Firstly, if this frequency is high, then there is large variation in the size of the force applied in the direction in which the toner moves to the developing roller, and if the force applied in the direction moving the toner to the developing roller is large, then toner adheres to the image area of the electrostatic latent image, whereas if the force applied in the direction moving the toner to the developing roller is small, then the toner adhering to the image area of the electrostatic latent image is left, while the toner which has adhered to the non-image area of the electrostatic latent image is peeled off. In other words, image reproducibility is improved and dot reproducibility is improved because toner adheres to the image area of the electrostatic latent image, and toner does not adhere to the non-image area of the electrostatic latent image. For this reason, if the frequency is too high, then there is a tendency for the charging non-uniformity to be reproduced faithfully.

Moreover, if the frequency is too low, then although the dot reproducibility as described above falls and reproduction of the charging non-uniformity is suppressed, the force moving the toner to the image area of the electrostatic latent image also falls and hence reproducibility tends to decline. For this reason, if the frequency is too low, then it tends to become impossible to achieve sufficient image density.

For these reasons, by keeping the frequency to the range described above, even if image formation is carried out over a long period of time, it is possible to form an image of high quality having good image reproducibility, while suppressing the occurrence of non-uniformities in image density as a result of charging non-uniformity.

Furthermore, the charging device 21 desirably performs charging in such a manner that the surface potential of the photosensitive drum 135 assumes a suitable potential value in relation to the frequency. More specifically, charging which satisfies Formula (I) below is desirable, and charging which satisfies Formula (II) below is more desirable.

$$75X+240 \leqq Y \leqq 600 \quad \text{(I)}$$

$$75X+300 \leqq Y \leqq 600 \quad \text{(II)}$$

In Formula (I) and Formula (II), X indicates the frequency (kHz) of the AC component of the developing bias voltage and Y indicates the surface potential (V) of the photosensitive drum. As stated above, X is 2.6 to 4.2 kHz.

By this means, it is possible to form an image of even higher quality over a long period of time, and it is also possible further to suppress damage to the image carrier.

This is thought to be due to the following reasons.

Firstly, if the frequency is relatively low and in the range of 2.6 to 4.2 kHz, then if the surface potential of the photosensitive drum is no more than 600V, which is a range whereby breaking of the photosensitive layer of the photosensitive drum can be restricted, it is possible to suppress the occurrence of charging non-uniformities while ensuring image reproducibility.

On the other hand, if the frequency is high, then image reproducibility is high, dot reproducibility is raised, and there is a tendency for charging non-uniformities to be reproduced faithfully. In the case of a frequency of this kind, it is possible to suppress the occurrence of charging non-uniformities since the surface potential of the photosensitive drum is relatively high in the frequency range of no more than 600V which is a range where breaking of the photosensitive layer of the photosensitive drum can be suppressed. By satisfying Formula (I), and desirably Formula (II), it is possible to satisfy a relationship whereby it is possible to suppress the occurrence of charging non-uniformities while ensuring image reproducibility.

Therefore, it is possible to form an image of even higher quality over a long period of time, and it is also possible further to suppress damage to the image carrier.

Furthermore, desirably, the frequency is 2.8 to 3.6 kHz and the charging device 21 performs charging in such a manner that the surface potential of the image carrier is 510 to 600 V, and more desirably, the frequency is 2.8 to 3.2 kHz and the charging device 21 performs charging in such a manner that a surface potential of the image carrier is 540 to 600V.

By this means, it is possible to form an image of even higher quality over a long period of time, and it is also possible further to suppress damage to the image carrier.

This is thought to be due to the following reasons.

Firstly, by making the frequency no more than 3.6 kHz, for example, and performing charging in such a manner that the surface potential of the image carrier is 510 to 600 V, the image carrier is charged in such a manner that the surface potential of the image carrier is sufficiently high, while suppressing breaking of the photosensitive layer of the image carrier. Therefore, it is possible further to suppress the occurrence of charging non-uniformities.

Moreover, by making the frequency no less than 2.8 kHz, for example, it is possible to improve the image reproducibility and to raise the dot reproducibility while suppressing the occurrence of charging non-uniformities.

Therefore, it is possible to form images of even higher quality over a long period of time, and it is also possible further to suppress damage to the image carrier.

Furthermore, the developing bias voltage application unit 237 further comprises a DC power supply which applies a DC voltage. More specifically, the developing bias voltage applied by the developing bias voltage application unit 237 may be a superimposed voltage in which an AC component is superimposed on a DC component.

Furthermore, desirably, the developing bias voltage applied by the developing bias voltage application unit 237 is a voltage as described below. The DC voltage applied by the DC power source (the voltage of the DC component of the developing bias voltage: Vdc) varies with the rotational velocity difference between the photosensitive drum and the developing roller (circumferential velocity ratio), and the like, but desirably, the DC voltage should be no more than 300V. Setting the voltage in this way is desirable, since the toner remaining on the photosensitive drum which has not been transferred to the intermediate transfer body can be removed readily, hysteresis is not liable to occur, and application of a strong electric field to the toner is prevented. Furthermore, the peak-to-peak value of the AC voltage applied by the AC power source (the peak-to-peak value Vpp of the AC component of the developing bias voltage) is desirably 1.3 to 1.6 kV.

Furthermore, the toner supply bias voltage application unit 236 comprises an AC power source which applies an AC voltage and a DC power source which applies a DC voltage. More specifically, the toner supply voltage applied by the toner supply bias voltage application unit 236 is a superimposed voltage in which an AC component is superimposed on a DC component.

Furthermore, the toner supply bias voltage applied by the toner supply bias voltage application unit 236 may be a voltage as described below. The DC voltage applied by the DC power source (the voltage of the DC component of the toner supply bias voltage: Vdc) varies with the rotational velocity difference between the magnetic roller and the developing roller (circumferential velocity ratio), and the like, but desirably, the DC voltage should be no more than 600V. If this DC voltage is too low, then there is a tendency for the thin layer of toner formed on the developing roller to become thin, and if the DC voltage is too high, then there is a tendency for the toner layer to become thick. Furthermore, the peak-to-peak value of the AC voltage applied by the AC power source (the peak-to-peak value Vpp of the AC component of the toner supply bias voltage) is desirably 0.5 to 0.7 kV.

The charge removal device 24 removes toner remaining on the circumferential surface of the photosensitive drum 135, after the toner on the circumferential surface of the photosensitive drum 135 has been transferred (primarily) to the intermediate transfer belt 132 by the primary transfer roller 133. The charge removal device 24 comprises a charging removal lamp 241, and by lighting this lamp, removes charge from the toner remaining on the circumferential surface of the photosensitive drum 135. The circumferential surface of the photosensitive drum 135 is charged, and therefore by removing the charge, it is possible to remove toner remaining on the circumferential surface of the photosensitive drum 135, satisfactorily, by means of the cleaning device 25 which is described below.

The cleaning device 25 serves to perform cleaning by removing toner remaining on the circumferential surface of the photosensitive drum 135. The circumferential surface of the photosensitive drum 135 which has been cleaned by the cleaning device 25 is guided to a charging position for a new image forming process. The waste toner removed by the cleaning device 25 is recovered and collected in a toner recovery bottle (not shown) via a prescribed path.

By adopting a composition of this kind, an image forming apparatus relating to the present embodiment is capable of forming an image of sufficiently high quality over a long period of time, as well as being able adequately to suppress the generation of ozone.

Furthermore, there are no particular restrictions on the positively charged single-layer electrophotographic photosensitive body which can be used as a photosensitive drum 135 in the present embodiment (hereinafter, simply called "photosensitive body" or "single-layer photosensitive body"), provided that it is suitable for application to an image forming apparatus comprising a charging device based on a contact charging method such as that described above. More specifically, for example, it is suitable to use a photosensitive body comprising a conductive base body and a photosensitive layer, the photosensitive layer being a layer containing, in a single layer, a charge generation material, a charge transport material and a binding resin, the yield point strain of the binding resin being 9 to 29%. Furthermore, a photosensitive body in which the yield point strain of the photosensitive layer is 5 to 25% is more desirable. By using a photosensitive body of this kind, even in an image forming apparatus having a charging device based on a contact charging method in which the load on the photosensitive layer of the photosensitive drum tends to become greater, wear of the photosensitive layer is suppressed, images of better image quality can be formed over a long period of time, and an image forming apparatus having even greater durability can be obtained.

Here, the yield point strain will be described. Both ends of a sample material are fixed by two chucks, and the sample is stretched by moving one chuck at a uniform speed. The stress is detected. If the relationship between the stress and the deformation is plotted as a graph, there is essentially a direct proportional relationship between the deformation and stress, but as the deformation becomes larger, relaxation occurs due to the elastic components, and the stress assumes a maximum value. This point is called the yield point. The yield point strain is a value expressing the extent of deformation of the sample at the yield point. This yield point strain can be measured by a commonly known method in the present embodiment, and for example, can be measured using a viscoelasticity measurement device, or the like, as described in the examples given below.

Figure 4A:
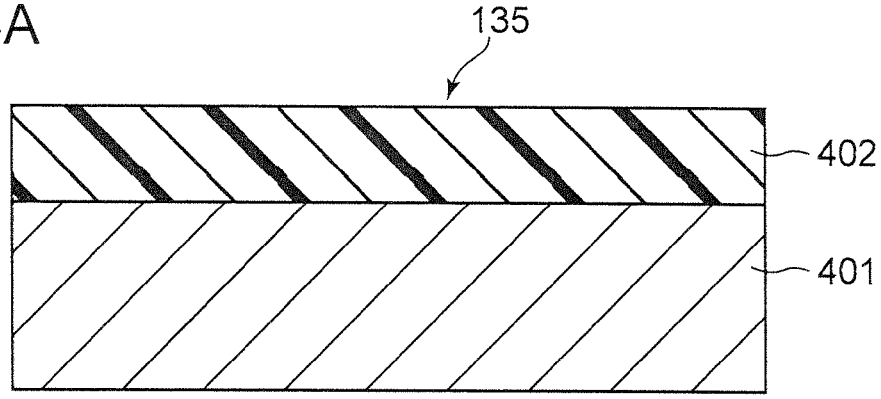
FIG. 4A to 4C are schematic cross-sectional drawings showing the structure of a positively charged single-layer electrophotographic photosensitive body provided in an image forming apparatus relating to one embodiment of the present invention.
Figure 4B:
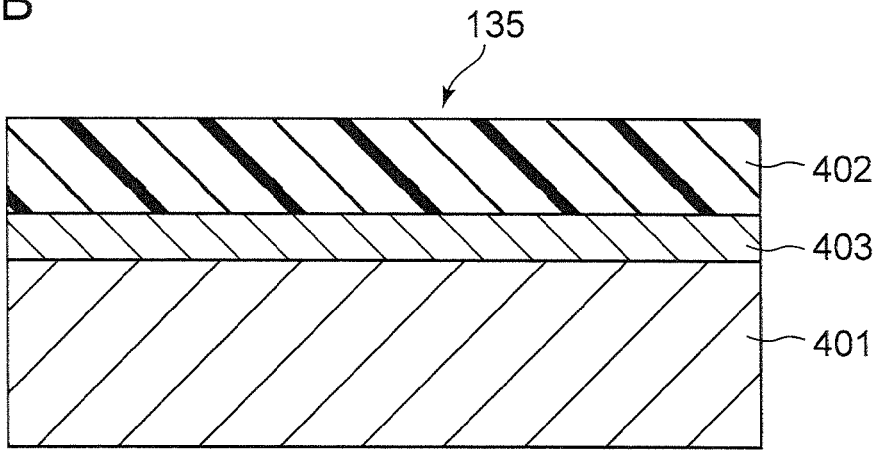
Figure 4C:
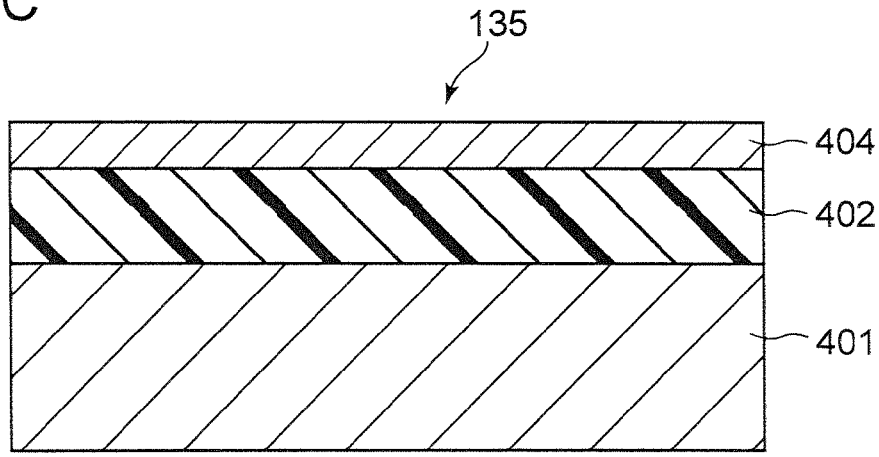

Furthermore, more specifically, the single-layer photosensitive body 135 may, for example, be constituted by a conductive base 401 and a photosensitive layer 402 as shown in FIG. 4A to 4C, and may further comprise layers other than a photosensitive layer and a conductive base. Moreover, as shown in FIG. 4A, the photosensitive layer 402 may be provided directly on the conductive base 401, or as shown in FIG. 4B, an intermediate layer 403 may be provided between the conductive base 401 and the photosensitive layer 402. Furthermore, as shown in FIG. 4A and FIG. 4B, the photosensitive layer 402 may be exposed and form an outermost layer, or as shown in FIG. 4C, a protective layer 404 may be provided on top of the photosensitive layer 402.

Moreover, as stated above, there are no particular restrictions on the single-layer photosensitive body 135, but desirably, an intermediate layer 403 is provided between the conductive base 401 and the photosensitive layer 402 as shown in FIG. 4B, this intermediate layer 403 being a high-resistance layer having a resistance higher than the conductive base 401. By this means, it is possible to suppress the occurrence of leaks from the charging roller of the charging device which may arise depending on the durability, when the photosensitive body is formed as a thin film.

There are no particular restrictions on the high-resistance layer, provided that it has a higher resistance than the resistance of the conductive base 401 and is capable of suppressing the occurrence of leaks, and possible examples thereof are an alumite layer, an aluminum iodide layer, a tin oxide layer, an indium oxide layer, a titanium oxide layer, and the like.

The thickness of the high-resistance layer varies with the material of the high-resistance layer, but a desirable thickness is 1 to 3 μm.

The method of forming the high-resistance layer is not subject to particular restrictions, provided that it is capable of forming the high-resistance layer on the conductive base. More specifically, if the conductive base is an aluminum tube, and the high-resistance layer is an alumite layer, then a possible method is one which performs anode oxidation processing of the aluminum tube, or the like. To give a more specific example, it is possible to employ anode oxidation processing, or the like, using an aqueous sulfuric acid solution, or the like, as the electrolyte. In this case, the process time is desirably between 0.5 and 300 minutes, approximately. Furthermore, if using an aqueous sulfuric acid solution as the electrolyte, a desirable concentration is approximately 0.1 to 80 mass %, for example. Moreover, the formation voltage in the anode oxidation process is desirably approximately 10 to 200V, for example.

Below, the conductive base and the photosensitive layer of a positively charged single-layer electrophotographic photosensitive body according to the present invention will be described in detail.

[Conductive Base]

The conductive base is not limited in particular, provided that it can be used as a conductive base for an electrophotographic photosensitive body. More specifically, in one possible example of a conductive base, at least a surface section is constituted by a material having conductivity, or the like. More specifically, the conductive base may be made of a material having conductivity, or the surface of a plastic material, or the like, may be coated with a material having conductivity. Furthermore, possible examples of the material having conductivity are: aluminum, steel, copper, tin, platinum, silver, vanadium, molybdenum, chrome, cadmium, titanium, nickel, palladium, indium, stainless steel, and brass. Moreover, the material having conductivity may use one of the aforementioned materials having conductivity or a combination of two or more types, for example, an alloy, or the like. Furthermore, of the aforementioned materials, aluminum or aluminum alloy are desirable for the conductive base. By this means, it is possible to provide a photosensitive body capable of forming a more satisfactory image. This is thought to be because there is good movement of charge from the photosensitive layer to the conductive base.

Moreover, there are no particular restrictions on the shape of the conductive base. More specifically, the shape may be a sheet shape or a drum shape, for example. In other words, the shape is not limited in particular, and may be a sheet shape or drum shape, in accordance with the shape of the image forming apparatus used.

[Photosensitive Layer]

The photosensitive layer used in the present embodiment should be suitable for use as a photosensitive layer of a single-layer electrophotographic photosensitive body, and as stated above, this photosensitive layer contains a charge generation material, a charge transport material, and a binding resin. Moreover, the structure of the photosensitive layer is, for example, the structure of the photosensitive layer shown in FIGS. 4A to 4C, which was described above, or the like.

Furthermore, there are no particular restrictions on the charge generation material, the charge transport material and the binding resin, and the like, which are contained in the photosensitive layer, but it is possible to use the following examples, for instance.

(Charge Generation Material)

There are no particular restrictions on the charge generation material, provided that it can be used as a charge generation material for a single-layer electrophotographic photosensitive body. More specifically, possible examples thereof are: an X-type non-metallic phthalocyanine (x-H2Pc) expressed by Formula (1) below, a Y-type oxo-titanyl phthalocyanine (Y-TiOPc) expressed by Formula (2) below, perylene pigment, bis azo pigment, dithioketo-pyrrolo-pyrrole pigment, non-metallic naphthalocyanine pigment, metallic naphthalocyanine pigment, squaraine pigment, trisazo pigment, indigo pigment, azulenium pigment, cyanine pigment, selenium, selenium tellurium, selenium arsenic, cadmium sulfide, amorphous silicon or another inorganic conductive powder, a pyrylium salt, anthranthrone pigment, triphenyl methane pigment, threne pigment, toluidine pigment, pyrazoline pigment, quinacridone pigment, or the like.

[Chemical Formula 1]

(1)

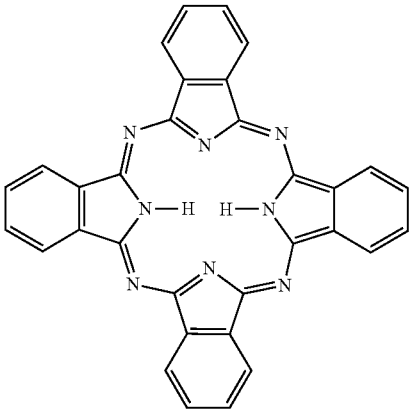

CGM-2

[Chemical Formula 2]

(2)

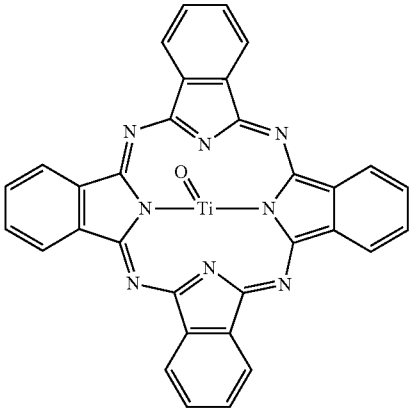

CGM-1

Furthermore, with regard to the charge generation material, it is possible to use only one charge generation material independently, or to use a combination of two or more types of charge generation material, so as to achieve an absorption wavelength in a desired region. Moreover, in an image forming apparatus based on a digital optics system, such as a laser beam printer or facsimile machine, which employs a semiconductor laser light source, in particular, it is necessary to use a photosensitive body having sensitivity in a wavelength region at and above 700 nm, and therefore, phthalocyanine pigments, such as non-metallic phthalocyanine or oxo-titanyl phthalocyanine, or the like, are suitable for use as the charge generation material. There are no particular restrictions on the crystal shape of the aforementioned phthalocyanine pigments, and pigments having various crystal shapes can be used. Furthermore, in an image forming apparatus based on an analogue optics system, such as an electrostatic copying machine, or the like, which uses a white light source such as a halogen lamp, or the like, a photosensitive body have sensitivity in the visible light region is required, and therefore it is suitable to use perylene pigment or bis azo pigment, or the like, as the charge generation material.

(Charge Transport Material)

There are no particular restrictions on the charge transport material, provided that it can be used as a charge transport material included in a photosensitive layer for a single-layer electrophotographic photosensitive body. Moreover, a charge transport material is generally a hole transport material or an electron transport material.

There are no particular restrictions on a hole transport material, provided that it can be used as a hole transport material included in a photosensitive layer for a single-layer electrophotographic photosensitive body. Specific examples thereof are: a benzidine derivative, an oxadiazole compound, such as 2,5-di(4-methylaminophenyl)-1,3,4-oxadiazole, a styryl compound such as 9-(4-diethylaminostyryl) anthracene, a carbazole compound, such as polyvinylcarbazole, an organic polysilane compound, a pyrazoline compound, such as 1-phenyl-3-(p-dimethylaminophenyl)pyrazoline, a nitrogenous cyclic compound, such as a hydrazone compound, a triphenyl amine compound, an indole compound, an oxazole compound, an isoxazole compound, a thiazole compound, a thiadiazole compound, an imidazole compound, a pyrazole compound, or a triazole compound, or a complex polycyclic compound, or the like. More specifically, for example, a compound expressed by one of the Formulas (3) to (11) below can be used. Furthermore, of the compounds given as examples above, a triphenylamine compound is desirable, and a triphenylamine compound as expressed by Formula (5) below is more desirable.

[Chemical Formula 3]

(3)

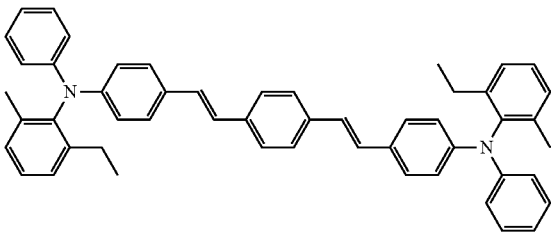

HTM-1

[Chemical Formula 4]

(4)

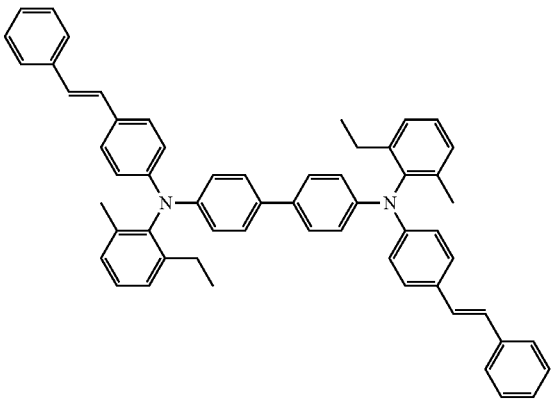

HTM-2

-continued
[Chemical Formula 5]
(5)
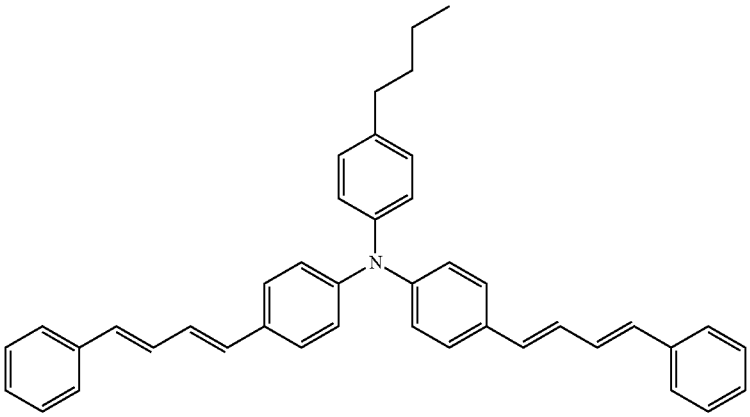
HTM-3
[Chemical Formula 6]
(6)
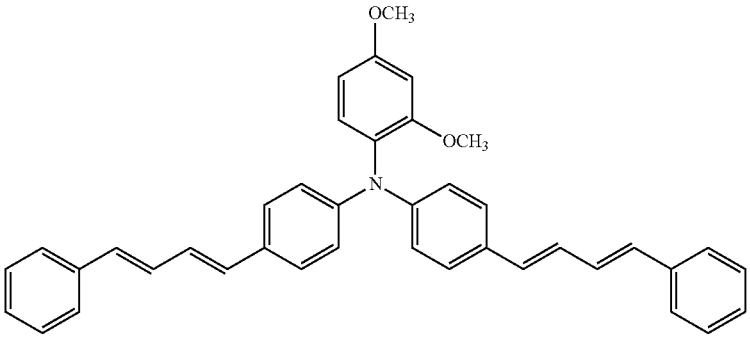
HTM-4

-continued
[Chemical Formula 7]
(7)
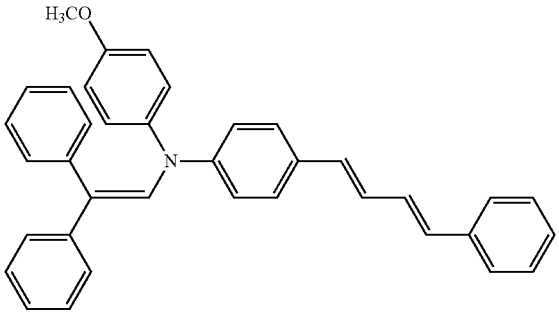
HTM-5
[Chemical Formula 8]
(8)
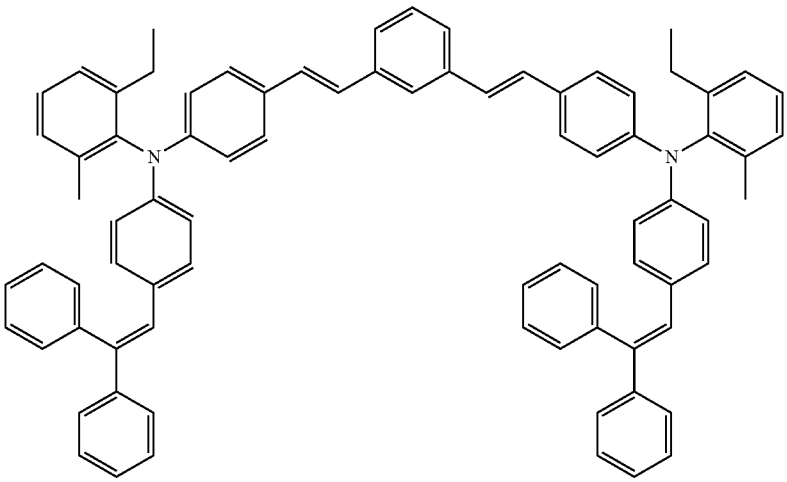
HTM-6

-continued

[Chemical Formula 9]

(9)

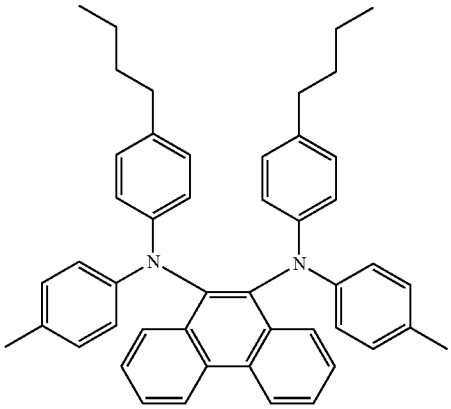

HTM-7

[Chemical Formula 10]

(10)

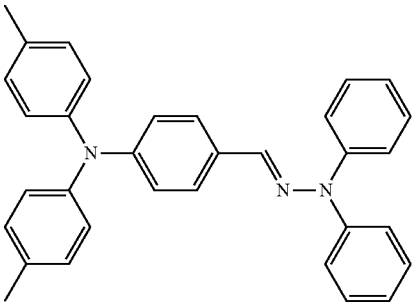

HTM-8

[Chemical Formula 11]

(11)

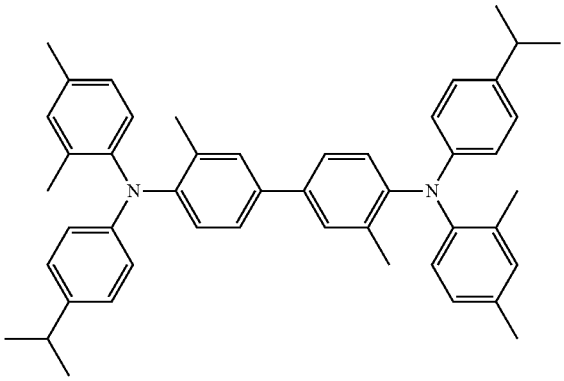

HTM-9

Furthermore, it is possible to use the respective hole transport materials given as examples above, either independently or as a combination of two or more types.

Moreover, there are no particular restrictions on the electron transport material, provided that it can be used as an electron transport material included in a photosensitive layer for a single-layer electrophotographic photosensitive body. Specific examples of an electron transport material are: a quinone derivative, such as a naphthoquinone derivative, a diphenoquinone derivative, an anthraquinone derivative, an azoquinone derivative, a nitroanthraquinone derivative, or a dinitroanthraquinone derivative, or a malononitrile derivative, a thiopyran derivative, a trinitrothioxanthone derivative, 3,4,5,7-tetranitro-9-fluoronenone derivative, a dinitroanthracene derivative, a dinitroacridine derivative, tetracyanoethylene, 2,4,8-trinitrothioxanthone, dinitrobenzene, dinitroanthracene, dinitroacridine, succinic anhydride, maleic anhydride, dibromomaleic anhydride, or the like. More specifically, for example, a compound expressed by one of the Formulas (12) to (14) below can be used. Furthermore, of the compounds given as examples above, a quinone derivative is desirable, and a quinone derivative expressed by Formula (13) below is more desirable.

[Chemical Formula 12]

(12)

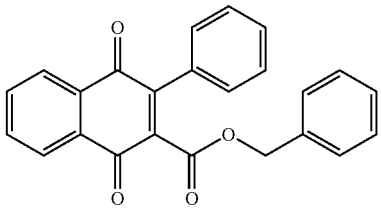

ETM-1

[Chemical Formula 13]

(13)

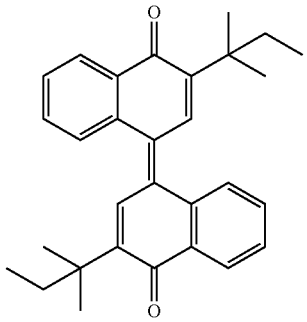

ETM-2

-continued

[Chemical Formula 14]

(14)

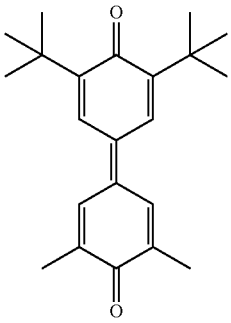

ETM-3

Furthermore, it is possible to use the respective electron transport materials given as examples above, either independently or as a combination of two or more types.

(Binding Resin)

There are no particular restrictions on the binding resin, provided that it can be used as a binding resin for a single-layer electrophotographic photosensitive body. Desirably, as described above, a binding resin having yield point strain of 9 to 29% is used. If a binding resin having a yield point strain in this range is used, then detachment of the film on the photosensitive body is further suppressed. If the yield point strain is too small, then the film on the photosensitive body tends to break more readily. Furthermore, if the yield point strain is too large, then image problems due to adhering matter or the like, tend to occur. If the yield point strain of the binding resin is in the range of 9 to 29%, then the yield point strain of the surface of the photosensitive body will probably be in the range of 5 to 25%, approximately. Therefore, it is possible to obtain the aforementioned beneficial effects by preparing the photosensitive body in such a manner that the yield point strain of the surface of the photosensitive body is in this range, but adjusting the yield point strain of the binding resin to the aforementioned range is preferable as it is more straightforward.

As a binding resin having a yield point strain of 9 to 29%, it is possible to use any resin provided that the yield point strain is in the aforementioned range; for example, it is possible to use a resin, such as polycarbonate resin, polyester resin, polyarylate resin, or the like, which each have a yield point strain in the aforementioned range. Of these, polycarbonate resin is desirable from the viewpoint of good compatibility of the hole transport material and the electron transport material.

A possible example of a polycarbonate resin is a polycarbonate resin comprising a repeated unit expressed by one of Formulas (15) to (17) below, for instance.

[Chemical Formula 15]

(15)

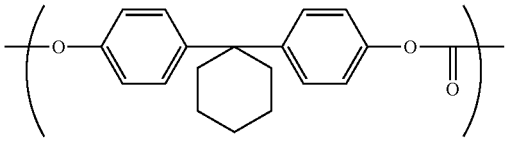

PC-Z

-continued

[Chemical Formula 16]

(16)

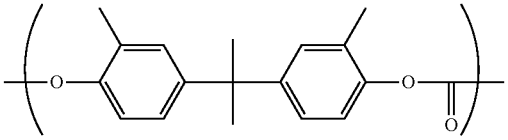

PC-C

[Chemical Formula 17]

(17)

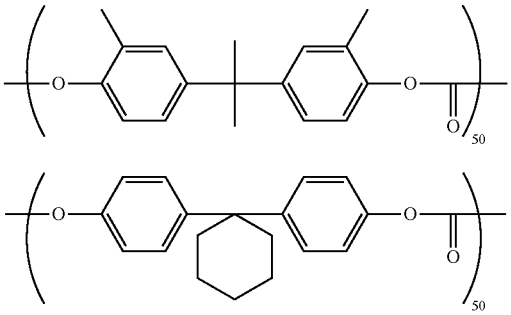

PC-C/PC-Z

In Formula (17), the number "50" indicates a copolymer having a copolymerization ratio of 50%. More specifically, a polycarbonate resin constituted by a repeated unit expressed by Formula (17) is a resin in which a repeated unit expressed by Formula (15) and a repeated unit expressed by Formula (16) are copolymerized at a copolymerization ratio of 50%.

Furthermore, there are no particular restrictions on the number of repeated units in the polycarbonate resin, but desirably the number of repeated units is such that the yield point strain is 9 to 29%.

Furthermore, if a polycarbonate resin is used as a binding resin, then the viscosity-average molecular weight is desirably no less than 30,000, more desirably, between 40,000 and 80,000, and even more desirably, between 45,000 to 75,000. If the number-average molecular weight of the polycarbonate resin is too low, then it is not possible to display a sufficient effect in raising the wear resistance of the polycarbonate resin, and the photosensitive layer tends to wear readily. Furthermore, if the number-average molecular weight of the polycarbonate resin is too high, then there are difficulties in forming a suitable photosensitive layer, for instance, the resin becomes less liable to dissolve in solvent, and it becomes harder to prepare a coating liquid, or the like, for forming a photosensitive layer, and hence there is a tendency for image problems to occur due to adhering matter.

Moreover, desirably, the binding resin consists of the polycarbonate resin described above, but it may also contain a resin other than the polycarbonate resin. There are no particular restrictions on the resin other than the polycarbonate, provided that it is a resin which can be used in a binding resin of a photosensitive layer. More specific examples of a further resin are: thermoplastic resins such as a styrene resin, a styrene—butadiene copolymer, a styrene—acrylonitrile copolymer, a styrene—maleic acid copolymer, a styrene—acrylic acid copolymer, an acrylic copolymer, a polyethylene resin, an ethylene—vinyl acetate copolymer, a polyethylene chloride resin, a polyvinyl chloride resin, a polypropylene resin, an ionomer, a vinyl chloride—vinyl acetate copolymer, an alkyd resin, a polyamide resin, a polyurethane resin, a polycarbonate resin, a polyallylate resin, a polysulfone resin, a diallyl phthalate resin, a ketone resin, a polyvinyl butylal resin, a polyether resin or a polyester resin, or cross-linking thermally curable resins such as a silicone resin, an epoxy resin, a phenol resin, an urea resin or a melamine resin, or photocurable resins such as epoxy acrylate resins or urethane—acrylate copolymer resins.

(Additives)

The photosensitive body may contain various additives other than the charge generation material, the charge transport material and the binding resin described above, within a range that does not adversely affect the electrophotographic properties. Specific examples of these additives may include, for instance: preserving agents, such as an anti-oxidant, a radical promoter, a singlet quencher, and an ultraviolet absorber, and/or a softener, plasticizer, surface modifier, filler, viscosity enhancer, dispersion stabilizer, wax, accepter, donor, surfactant, leveling agent, or the like. Moreover, in order to improve the sensitivity of the photosensitive layer, it is also possible to employ a commonly known sensitizing agent, such as terphenyl, a halonaphthoquinone, acenaphthylene, or the like, as a charge generation material.

[Method of Manufacturing Single-Layer Photosensitive Body]

Next, the method of manufacturing the single-layer photosensitive body will be described.

The single-layer photosensitive body can be manufactured by applying a coating liquid to the conductive base by coating, or the like, and then drying the liquid, the coating liquid being composed by dissolving or dispersing the aforementioned charge generation material, the aforementioned charge transport material, the binding resin, and various additives according to requirements, and the like. There are no particular restrictions on the coating method, but a dip coating method, or the like, is a possible example. Furthermore, the drying method may be, for example, a method where hot air drying is carried out at 80 to 150° C. for 15 to 120 minutes.

In the single-layer photosensitive body described above, the content amounts of the charge generation material, the charge transport material and the binding resin are selected appropriately and are not subject to particular restrictions. More specifically, the content of the aforementioned charge generation material is desirably 0.1 to 50 parts by mass, and more desirably, 0.5 to 30 parts by mass, with respect to 100 parts by mass of binding resin. Furthermore, the content of the aforementioned electron transport material is desirably 5 to 100 parts by mass, and more desirably 10 to 80 parts by mass, with respect to 100 parts by mass of binding resin. Moreover, the content of the aforementioned hole transport material is desirably 5 to 500 parts by mass, and more desirably 25 to 200 parts by mass, with respect to 100 parts by mass of binding resin. Furthermore, the total amount of the hole transport material and the electron transport material, in other words, the content of the aforementioned charge transport material, is desirably 20 to 500 parts by mass, and more desirably 30 to 200 parts by mass, with respect to 100 parts by mass of binding resin. Furthermore, if an electron accepting compound is included in the photosensitive layer, then the content of electron accepting compound is desirably 0.1 to 40 parts by mass, and more desirably, 0.5 to 20 parts by mass, with respect to 100 parts by mass of binding resin.

Moreover, there are no particular restrictions on the thickness of the photosensitive layer in the single-layer photosensitive body, provided that the photosensitive layer has a satisfactory action. More specifically, a thickness of 5 to 100 μm is desirable and a thickness of 10 to 50 μm is more desirable.

Furthermore, there are no particular restrictions on the solvent contained in the coating liquid, provided that it is capable of dissolving or dispersing the respective components. Specific examples of the solvent may include: alcohols, such as methanol, ethanol, isopropanol, or butanol; aliphatic hydrocarbons, such as n-hexane, octane, cycylohexane, or the like; aromatic hydrocarbons, such a benzene, toluene, or xylene; halogenated hydrocarbons, such as dichloromethane, dichloroethane, carbon tetrachloride, or chlorobenzene; ethers such as dimethyl ether, diethyl ether, tetrahydrofuran, ethylene glycol dimethyl ether, or diethylene glycol dimethyl ether; ketones such as acetone, methylethyl ketone or cyclohexanone; esters, such as ethyl acetate or methyl acetate, dimethyl formaldehyde, dimethyl formamide, dimethyl sulfoxide, or the like. Furthermore, it is possible to use the respective solvents given as examples above, either independently or as a combination of two or more types.

According to the image forming apparatus 10 relating to the present embodiment which was described above, it is possible to suppress the occurrence of image density non-uniformities due to charging non-uniformities, and an image having excellent image reproducibility in terms of dot reproducibility, and the like, can be formed. Therefore, it is possible to form an image of sufficiently high quality over a long period of time, as well as being able adequately to suppress the generation of ozone.

The present invention is not limited to the embodiments described above and also includes the following contents, for example.

In the embodiment described above, a color printer is given as an example of an image forming apparatus. Instead of this, it is also possible for the image forming apparatus to be a copying machine, a facsimile machine, or a multifunction peripheral of these.

Furthermore, in the present embodiment, a so-called tandem image forming apparatus is given as an example of an image forming apparatus, in which image forming units of a plurality of colors are arranged in parallel, toner images formed by the image forming units are transferred primarily to an intermediate transfer body, and these transferred toner images are then transferred secondarily onto a recording medium such as paper. Instead of this, it is also possible for the image forming apparatus to be one in which a toner image formed by an image forming unit is transferred directly onto a recording medium, such as paper.

[Investigation Examples]

There follows a description of the results of investigation made into the developing bias voltage conditions in an image forming apparatus relating to an embodiment of the present invention, and more specifically, the frequency of the AC component of a developing bias voltage.

Firstly, the image forming apparatus used was one where the image carrier and charging device provided in a color printer (Kyocera Mita FS-05300 DN) were substituted with the positively charged single-layer electrophotographic photosensitive body and the charging device based on a contact charging method which are described below.

(Positively Charge Single-Layer Electrophotographic Photosensitive Body)

5 parts by mass of X-type non-metallic phthalocyanine (x-H2Pc) expressed by Formula (1) above as a charge generation material, 50 parts by mass of triphenylamine compound expressed by Formula (5) above, as a hole transport material, 35 parts by mass of quinone derivative expressed by Formula (13) below, as an electron transport material, and 100 parts by mass of polycarbonate resin expressed by Formula (15) below (yield point strain 29%, viscosity-average molecular weight 75000), as a binding resin, were mixed together and dispersed for 50 hours in ball mill, together with 800 parts by mass of tetrahydrofuran. By this means, a coating liquid for forming a photosensitive layer was obtained.

The coating liquid thus obtained was coated onto a conductive base consisting of an alumite tube, by dip coating, and then dried by hot air for 40 minutes at 100° C. In so doing, a photosensitive body (diameter 30 mm) having a photosensitive layer with a film thickness of 25 μm was obtained. The yield point strain of the photosensitive layer of the photosensitive body thus obtained was 23%.

The yield point strain of the photosensitive layer and the binding resin was measured under the following evaluation conditions, using a viscoelasticity measurement device (TA Instruments "DMA-Q800").

Initial load: 1N

Measurement temperature: 30° C.

Deformation rate: 0.5%/min.

(Sampling interval: every 2 seconds)

(Charging Device Based on Contact Charging Method)

A charging device based on a contact charging method employing the charging roller described below was used.

The charging roller used was a charging roller having a surface section (rubber layer) constituted by rubber having epichlorohydrin rubber as a main component (a charging roller made by Tokai Rubber Industries, Ltd.; rubber hardness of surface section: Asker C hardness of 71°, ten-point average roughness (Rz) 10 μm, average distance between asperity peaks on a cross-sectional curve (Sm) 90 μm, thickness of rubber layer 2 mm).

The rubber hardness of the surface section of the charging roller is the Asker C hardness and more specifically, the value measured by pressing an Asker C hardness tester made by Kobunshi Keiki Co., Ltd. directly against a charging roller by means of a constant load stand made by Kobunshi Keiki.

Furthermore, the average distance (Sm) between asperity peaks on a cross-sectional curve and the ten-point average roughness (Rz) can be measured respectively by a measurement method conforming to JIS B 0601-1994. More specifically, the value is measured using a SURFCOM 1500 DX surface texture measurement instrument made by Tokyo Seimitsu Co., Ltd.

Using the image forming apparatus described above and the charging device described above, charging was performed in such a manner that the surface potential of the image carrier became the potential shown in Table 1, the frequency of the AC component of the developing bias voltage was set to the frequency shown in Table 1, and an image including dots and a solid image was formed. In this case, the voltage Vdc of the AC component of the developing bias voltage was set to 420V, and the peak-to-peak value Vpp of the AC component of the developing bias voltage was set to 1400 kV.

The image obtained in this case was evaluation as described below.

(Dot Reproducibility)

The dots of the formed image were confirmed visually.

When the shape of the dots, in other words, the uniformity of the dot shape could be verified, then an "A" verdict was awarded, if the dots were reproduced, but non-uniformity was observed in the obtained dot shape, then a "B" verdict was awarded, and if portions where the dots were not reproduced, in other words, missing portions thought to be caused by toner not adhering to the electrostatic latent image, could be observed, then a "C" verdict was awarded.

(Image Density Non-Uniformity)

It is confirmed visually whether or not non-uniformity occurs in the portion of the solid image formed. If non-uniformities could not be observed in the obtained image even in a case where a solid image was formed by mixing two or more colors, an "A" verdict was awarded, if non-uniformities could not be observed in the obtained image when a solid image was formed by one color, but if non-uniformities could be observed in the obtained image when a solid image was formed by mixing two or more colors, a "B" verdict was awarded, and if non-uniformities could be observed in the obtained image even when a solid image was formed by one color, then a "C" verdict was awarded.

(Breaking of Photosensitive Body)

A half tone image was formed under conditions of temperature 32.5° C. and relative humidity 80% RH, using the image forming apparatus described above. The image printed after printing 1000 half tone images was evaluated under these conditions. More specifically, it was confirmed visually whether or not there were black spots or white spots thought to be caused by breaking of the photosensitive layer of the photosensitive drum, in the image obtained. If black spots and white spots were not observed, then an "A" verdict was awarded, and if at least one of either black spots or white spots was observed, then a "C" verdict was awarded.

(Overall Assessment)

If the evaluation was "A" for each item of the dot reproducibility, image density non-uniformity and breaking of the photosensitive body, then an "A" verdict was awarded. Furthermore, if the evaluation was "C" for each item of the dot reproducibility, image density non-uniformity and breaking of the photosensitive body, then a "C" verdict was awarded. Moreover, if the evaluation was "B", rather than "C", for any one or more of the dot reproducibility; image density non-uniformity and breaking of the photosensitive body, then a "B" verdict was awarded.

Table 1 shows the evaluation results for the dot reproducibility, the image density non-uniformity and the breaking of the photosensitive body, and Table 2 shows the evaluation for the overall assessment.

TABLE 1

| | | FREQUENCY OF AC COMPONENT OF DEVELOPING BIAS VOLTAGE (kHz) | | | | | | | | |
|---|---|---|---|---|---|---|---|---|---|---|
| | | 2.4 | | | 2.8 | | | 3.2 | | |
| | | Image density non-uniformity | Dot reprod-cibility | Breaking of photo-sensitive body | Image density non-uniformity | Dot reprod-cibility | Breaking of photo-sensitive body | Image density non-uniformity | Dot reprod-cibility | Breaking of photo-sensitive body |
| Charging potential (V) | 450 | C | A | A | B | A | A | C | A | A |
| | 480 | A | C | A | B | A | A | B | A | A |
| | 510 | A | C | A | A | A | A | B | A | A |
| | 540 | A | C | A | A | A | A | A | A | A |

TABLE 1-continued

| | | | | | | | | | | |
|---|---|---|---|---|---|---|---|---|---|---|
| | 570 | A | C | A | A | A | A | A | A | A |
| | 600 | A | C | A | A | A | A | A | A | A |
| | 630 | A | C | C | A | B | C | A | A | C |

| | | FREQUENCY OF AC COMPONENT OF DEVELOPING BIAS VOLTAGE (kHz) | | | | | | | | |
|---|---|---|---|---|---|---|---|---|---|---|
| | | 3.6 | | | 4 | | | 4.4 | | |
| | | Image density non-uniformity | Dot reprod-cibility | Breaking of photo-sensitive body | Image density non-uniformity | Dot reprod-cibility | Breaking of photo-sensitive body | Image density non-uniformity | Dot reprod-cibility | Breaking of photo-sensitive body |
| Charging potential (V) | 450 | C | A | A | C | A | A | C | A | A |
| | 480 | C | A | A | C | A | A | C | A | A |
| | 510 | B | A | A | C | A | A | C | A | A |
| | 540 | B | A | A | B | A | A | C | A | A |
| | 570 | A | A | A | B | A | A | C | A | A |
| | 600 | A | A | A | A | A | A | C | A | A |
| | 630 | A | A | C | A | A | C | C | A | C |

TABLE 2

| | | Frequency of AC component of developing bias voltage(kHz) | | | | | |
|---|---|---|---|---|---|---|---|
| | | 2.4 | 2.8 | 3.2 | 3.6 | 4 | 4.4 |
| Charging potential (V) | 450 | C | B | C | C | C | C |
| | 480 | C | B | B | C | C | C |
| | 510 | C | A | B | B | C | C |
| | 540 | C | A | A | B | B | C |
| | 570 | C | A | A | A | B | C |
| | 600 | C | A | A | A | A | C |
| | 630 | C | C | C | C | C | C |

As Table 1 and Table 2 reveal, by setting the frequency of the AC component of the developing bias voltage (developing frequency) to 2.6 to 4.2 kHz, then image density non-uniformities can be suppressed, dot reproducibility can be raised, and images of high quality can be formed, even if performing charging in such a manner that the surface potential of the image carrier is no more than 600V, which is a range in which there is little risk of breaking of the photosensitive layer.

On the other hand, if the developing frequency was set to be less than 2.6 kHz or greater than 4.2 kHz, then it was not possible to form an image of high quality, even if charging was performed in such a manner that the surface potential of the image carrier was any charging potential in a range no greater than 600V, which is a range where there is little risk of breaking of the photosensitive layer. In other words, if the developing frequency is low, the dot reproducibility declines. If the developing frequency is too low, then even if the surface potential is lowered, it is not possible adequately to suppress image density non-uniformities due to charging non-uniformities. Furthermore, if the developing frequency is high, then image density non-uniformities are liable to occur. On the other hand, if it is sought to suppress the occurrence of image density non-uniformities by raising the charging potential, then there is a risk of breaking of the image carrier.

Consequently, by setting the developing frequency to the range described above, even in an image forming apparatus comprising a positively charged single-layer electrophotographic photosensitive body and a charging device based on a contact charging method, it is still possible to form a satisfactory image while suppressing breaking of the photosensitive layer of the positively charged single-layer electrophotographic photosensitive body. In other words, by setting the developing frequency to the range of 2.6 to 4.2 kHz, then even with a positively charged single-layer electrophotographic photosensitive body, it is possible to adjust the surface potential to a potential capable of forming satisfactory images over a long period of time, while suppressing breaking of the photosensitive layer.

Moreover, from Table 1 and Table 2, it can be seen that, desirably, Formula (I) is satisfied, and more desirably, Formula (II) is satisfied.

Furthermore, from Table 1 and Table 2, it can be seen that, desirably, the developing frequency is 2.8 to 3.6 kHz and the surface potential of the image carrier is 510 to 600 V, and more desirably, the developing frequency is 2.8 to 3.2 kHz and the surface potential of the image carrier is 540 to 600 V.

This application is based on Japanese Patent application Nos. 2010-129100 and 2010-290116 filed in Japan Patent Office on Jun. 4, 2010 and Dec. 27, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image carrier configured by a positively charged single-layer electrophotographic photosensitive body;

a charging device which is based on a contact charging method for charging a circumferential surface of the image carrier while making contact with the circumferential surface of the image carrier;

a developing roller disposed to oppose the image carrier and carrying and conveying toner on the circumferential surface;

a magnetic roller disposed to oppose the developing roller, the magnetic roller carrying and conveying a two-component developer including the toner on the circumferential surface; and a voltage application unit which applies a developing bias to the developing roller, wherein the frequency of an AC component of the developing bias applied by the voltage application unit is 2.6 to 4.2 kHz, and the charging device performs charging so as to satisfy Formula (I) below:

$$75X+240 \leqq Y \leqq 600 \quad \text{(I)}$$

where, X indicates the frequency (kHz) of the AC component of the developing bias voltage and Y indicates the surface potential (V) of the image carrier.

2. The image forming apparatus according to claim 1, wherein the developing roller and the image carrier are arranged, with respective circumferential surfaces thereof being in a mutually proximate and separated state; and the voltage application unit applies a developing bias to the developing roller, the developing bias developing an electrostatic latent image formed in advance on the circumferential surface of the image carrier, into a toner image by causing toner conveyed by the developing roller to be propelled onto the circumferential surface of the image carrier.

3. The image forming apparatus according to claim 1, wherein the frequency of an AC component of the developing bias applied by the voltage application unit is 2.8 to 3.6 kHz; and the charging device performs charging such that the surface potential of the image carrier is 510 to 600V.

* * * * *